United States Patent [19]

Geldwerth

[11] Patent Number: 4,713,865

[45] Date of Patent: Dec. 22, 1987

[54] STREAMLINED UNOBSTRUSIVE JEWELRY CLASP, MEMBERS FORMING SAME AND BLANK

[75] Inventor: Simon Geldwerth, Brooklyn, N.Y.

[73] Assignee: Do-All Jewelry Mfg. Co., Inc., Springfield, N.J.

[21] Appl. No.: 883,345

[22] Filed: Jul. 8, 1986

[51] Int. Cl.[4] ..... A44B 11/25

[52] U.S. Cl. ..... 24/616; 24/615

[58] Field of Search ..... 24/616, 615, 618, 196, 24/323, 163 K

[56] References Cited

U.S. PATENT DOCUMENTS

| | | | |
|---|---|---|---|
| 737,064 | 8/1903 | Bigney . | |
| 1,421,388 | 7/1922 | Bippart . | |
| 1,737,246 | 11/1929 | Jones | 24/616 |
| 2,952,058 | 9/1960 | Geldwerth | 24/616 |
| 3,308,517 | 3/1967 | Geldwerth | 24/616 |
| 3,947,932 | 4/1976 | Flynn | 24/616 |
| 4,150,464 | 4/1979 | Tracy | 24/615 |
| 4,246,680 | 1/1981 | Gray | 24/616 |
| 4,408,375 | 10/1983 | Skobel | 24/615 |
| 4,543,692 | 10/1985 | Ode et al. | 24/616 |
| 4,621,393 | 11/1986 | Ambal | 24/616 |

FOREIGN PATENT DOCUMENTS

| | | | |
|---|---|---|---|
| 892305 | 2/1972 | Canada | 24/616 |
| 860867 | 1/1941 | France | 24/616 |
| 2451175 | 11/1980 | France | 24/616 |
| 0000120 | of 1900 | United Kingdom . | |

*Primary Examiner*—Victor N. Sakran

*Attorney, Agent, or Firm*—Sandler & Greenblum

[57] ABSTRACT

Clasp for connecting one end of a piece of jewelry to the other and includes a tongue member and a box member. The tongue member has a base with opposite edges, a front end, and a transverse attachment portion at the rear end for attachment to one end of the piece of jewelry. The box member has a base with a front end and with opposite upstanding side walls, and a transverse attachment portion connecting the side walls at the front end for attachment to the other end of the piece of jewelry. The attachment portion of the box member forms a transverse opening wide enough to receive the front end of the base of the tongue member. Each member is constructed and arranged such that the opposite edges of the tongue member slideably engage the upstanding side walls of the box member when the front end of the tongue member is inserted into the opening. The tongue member is provided with a pair of resilient detents integral with and defining the edges of the base. A pair of detent receptors is provided in the upstanding walls in the box member for receiving the detents and releaseably preventing separation of the members when they are mated by insertion of the front end of the tongue member into the opening until the attachment portions on the members are adjacent to each other. Blanks for forming the tongue and box members.

22 Claims, 7 Drawing Figures

STREAMLINED UNOBSTRUSIVE JEWELRY CLASP, MEMBERS FORMING SAME AND BLANK

1. Field of the Invention

The invention relates to; and unobtrusive jewelry clasp for connecting one end of a piece of jewelry to other end; to the members forming the clasp; and to the blanks forming the members.

2. Background of the Invention

The function of a jewelry clasp is to detachably connect the two ends of a piece of jewelry, such as a bracelet. The clasp must simultaneously provide a secure connection to allow the jewelry to be worn safely, and yet be manipulatable in a way that effects its release in a relatively easy way. Conventionally, a safety catch is provided as an auxiliary catch, usually in the shape of a figure-eight to prevent accidental release of the clasp and the consequent loss of the jewelry to which the clasp is attached.

In some types of jewelry, the clasp should be as unobtrusive as possible so that the article of jewelry to which it is attached appears to be almost continuous under other than close inspection. As the size of the clasp is reduced, the efficacy of the connection is often reduced to a point where the safety catch is required to prevent accidental release of the clasp and the loss of the article of jewelry. The provision of the safety catch under these circumstances, while necessary for practical reasons, aesthetically detracts from the jewelry and is undesirable for this reason.

An object of the present invention is to provide a new and improved jewelry clasp which is configured to be unobtrusive when attached to a piece of jewelry, and which, nonetheless, securely connects the ends of the piece of jewelry while providing the user with a relatively easy and convenient way to open the clasp.

The following materials are cited as being of background interest:

British Pat. No. 120 discloses a hook and eye for use on garments and as a substitute for buckles and other fasteners. Although the patent states that the hooks and eyes are useful generally on a great variety of articles, jewelry is not mentioned. Attention is directed generally to FIGS. 1-6 of the patent which show a male member (FIGS. 1-5) and female member (FIG. 6), the male member being provided with an outer spring mechanism having projections x3 and y3 which limit the amount that the spring members may be compressed upon insertion and removal of the male member, as well as outer portions x4 and y4 which appear to be positioned so as to be able to contact portion d (FIG. 1) of the female member upon compression of the spring during opening of the clasp.

U.S. Pat. No. 737,064 discloses a bracelet clasp (see FIGS. 3 and 4) in which a spring having a flattened configuration is illustrated.

U.S. Pat. No. 1,421,388 is directed to a clasp in which the male portion slides into a box and is provided with ear portions which are laterally limited by the exterior dimensions of the female box element (FIG. 7).

It is noted that in none of the above materials is the clasp truly unobtrusive and virtually invisible.

BRIEF DESCRIPTION OF THE INVENTION

It is, therefore, an object of the invention to provide an improved clasp which is unobtrusive and which can be made extremely flat. The streamlining of the catch not only provides a very attractive appearance, but also allows the clasp to be of lightweight construction, particularly the tongue portion of the clasp.

It is a further object of the invention to provide a clasp which is secure, and not easily susceptible to accidental opening, such as might occur with other clasps when a single button is pushed.

By providing a secure clasp it is yet a further object of the invention to obviate the need of additional security mechanisms which are bulky and sometimes unattractive.

According to yet another aspect of the invention, the attachment portions can be trimmed to match both ends of the jewelry thus resulting in a more streamlined appearance, with the clasp being lighter and consequently less expensive.

The jewelry clasp according to the present invention includes a tongue member having a base with opposite sides, a front end on the base, and a transverse attachment portion at the rear end of the base for attachment to one end of the piece of jewelry. The clasp also includes a box member having a base with a front end and with opposite, upstanding side walls, and a transverse attachment portion connecting the side walls at the front end of the base for attachment to the other end of the piece of jewelry. The attachment portion of the box member forms an opening wide enough to receive the front end of the base of the tongue member. The tongue and box members of the clasp are constructed and arranged such that the opposite sides of the tongue member slidably engage the upstanding side walls of the box member when the front end of the tongue member is inserted into the opening in the box member.

A pair of resilient detents are provided on the tongue member integral with and defining the sides of the base thereof. A pair of detent receptors in the upstanding walls on the box member receive the detents and releasably prevent separation of the members when they are mated by inserting the front end of the tongue member into the opening in the box member until the attachment portions on the members are adjacent.

A clasp according to the present invention is unobtrusive because, when the tongue member is mated with the box member, (i.e., the attachment portions thereof are adjacent), the only portion of the clasp that is visible is the relatively thin metal that constitutes the attachment portions. Mating of the members of a clasp according to the present invention is facilitated because the opposite edges of the tongue member slidably engage the upstanding side walls of the box member during the mating operation thus guiding the tongue member. As a consequence, the tongue slips easily into the box without jamming.

In another aspect of the present invention, the detents are formed by slitting the base of the tongue member along the length of the base adjacent the edges thereof to form a pair of resilient arms that are cantilevered to the base adjacent the front end thereof and define the edges of the tongue member. Each arm may include a cam portion that extends outwardly therefrom and is tapered towards the front end of the base of the tongue member. In such a case, the detent receptors are apertures in the upstanding side walls of the box member positioned to receive the cam portions when the members are mated.

Each arm may terminate in an operating portion accessable from the exterior of the clasp when the members are mated and located on opposite sides of the clasp. The operating portions may be rounded or flat. If flat, they may then be capped with a rounded cap (in three dimensions) to facilitate use. The members are constructed and arranged such that inwardly directed pressure simultaneously applied to the operating portions of the resilient arms is required to flex the arms toward each other and retract the cam portions from the detent receptors thereby effecting withdrawal of the tongue member from the box member. The requirement to apply simultaneous and oppositely directed pressure to the operating portion on the resilient arm ensures against accidental retraction of the cam members from the detent receptors in the side walls and prevents inadvertent opening of the clasp.

In another aspect of the present invention, the upstanding side walls on the box member terminate in perpendicular flanges that overlie the base of the box member and simultaneously form guides that engage the tongue, and supports that engage the underside of a free end of a piece of jewelry and faciliate attachment of the box member to the article of jewelry. The rigidity of the box member and the facility with which the latter is connected to the piece of jewelry are enhanced by providing a perpendicular flange attached to the transverse connecting portion of the box member and extending inwardly away from the end thereof. This last mentioned flange is coplanar with the flanges on the upstanding walls and provides a firm support for the jewelry and contributes to the rigidity of the box member as well. Thus, the box member, while constructed from relatively thin sheet metal, will be relatively rigid.

The attachment portion may be contiguous with the inwardly extending flange, in which case the inwardly extending flange fits between the two folded sides of the box member. Alternatively, the attachment portion and inwardly extending flange may be formed contiguous with one of the sides of the box member. In this case the inwardly extending flange and attachment portion are long enough to extend the width of the box where they are soldered in an open space at the other side of the box. In yet another embodiment each of the box sides is contiguous with an attachment portion and inwardly extending flange portion which are then bent and welded together to form a seam.

In another aspect of the present invention, the transverse connecting portion of the tongue member may itself include a perpendicular flange for forming a support for an end of the piece of jewelry. To accomplish this, the transverse connecting portion of the tongue member may be slit to permit a flange to be folded down out of the plane of the connecting portion for engagement with the end of the jewelry thus providing a more secure attachment thereto.

Finally, the invention is also concerned with blanks by which each of the tongue member and box member may be stamped from a single piece of sheet metal thus facilitating the manufacture of the clasp by means of punching, slitting and folding operations, as well as providing a clasp of minimum volume.

The blank for the box member of a jewelry clasp according to the invention includes a flat plate having a front end, rear end and sides adapted to be folded twice along substantially parallel imaginary fold lines to form a U-shaped track on both sides of the flat plate. The plate comprises an aperture between each of the imaginary fold lines on each side of the plate. There is also a straight front edge on each side of the plate.

In one embodiment an ear portion is symmetrically positioned on each of the sides. Each of the ears is secured to each of the sides by a securing portion defined at one end one of the flattened front edges. The ear portion comprises an imaginary fold line substantially perpendicular to the substantially parallel fold lines, and comprises one edge substantially perpendicular to each of the flattened front edges. The front end comprises a rounded portion between each of the flattened front edges.

In another embodiment the blank has no ears such that the attachment portion and inwardly extending flange are provided in the form of an insert which is welded between the folded sides of the box member.

In yet another embodiment only one ear forming the attachment portion and inwardly directed flange is provided which is elongated to extend from one side of the box to the other.

A tongue member blank is provided according to the invention which comprises:

(a) a flat plate having a front edge, a rear edge and parallel side edges;

(b) a pair of facing, L-shaped slots symmetrically located in the plate;

(c) each slot having a toe portion adjacent and parallel to the front edge of the plate and extending perpendicular to the side edges, and a leg portion adjacent and parallel to the side edges;

(d) a slit in each side portion of the plate adjacent the free end of the leg so that the slots define a pair of resilient arms; and (e) each arm having a slot in the forward end thereof opening toward the front edge of the plate.

The flat plate comprises an imaginary fold line at the level of the top of said resilient arms, and may further comprise a U-shaped slit between the imaginary fold line and the front edge whereby a flange is formed having a flange fold line parallel to the imaginary fold line. Likewise, the flat plate may further comprise a slit extending beyond the top of each of the arms and above the imaginary fold line, on each side of the plate, interior to the arms, to the level of said flange fold line.

BRIEF DESCRIPTION OF THE DRAWINGS

An embodiment of the present invention is illustrated in the accompanying drawings wherein.

DETAILED DESCRIPTION

Figure 1:
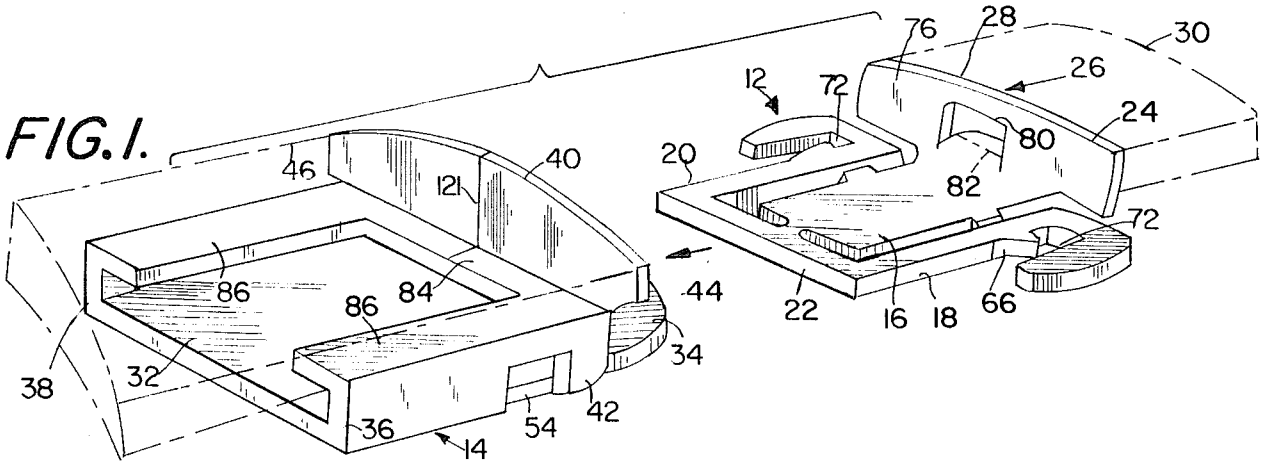
FIG. 1 is a perspective view of a clasp according to the present invention comprising a tongue member and a box member showing the tongue member about to be mated with the box member.

Referring now to FIG. 1, of the drawing, reference numeral 10 designates a clasp according to the present invention comprising tongue member 12 and box member 14. Tongue member 12 includes base 16 having opposite edges 18, 20, front end 22, and transverse attachment portion 24 at rear end 26 of the base member for attachment to end 28 of jewelry 30, which, for example, may be a bracelet.

As shown, box member 14 includes base 32 with curved front end 34, and opposite, upstanding side walls 36, 38. The box member also includes transverse attachment portion 40 connected to side walls 36 and 38 near the front end 44 of base 32. Attachment portion 40 provides a way in which to attach end 46 of jewelry 30 to the box member. Attachment portion 40 of box member 14 also forms transverse opening 48 (see FIG. 2) wide enough to receive front end 22 of base 16 of tongue member 12. The transverse attachment portion may be formed integrally as a result of the stamping process such as shown with a weld seam 121.

Figure 1A:
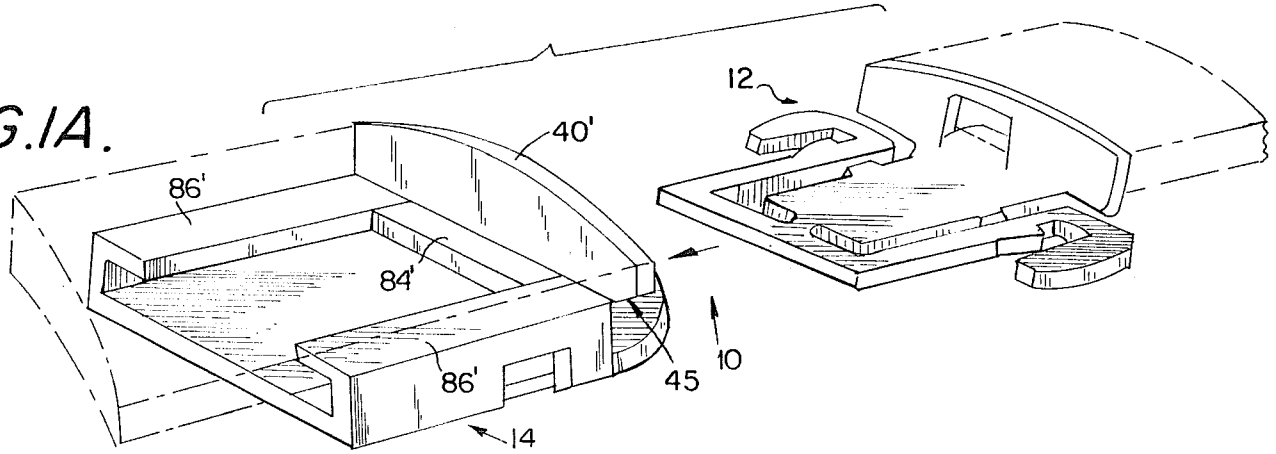
FIGS. 1A–1B illustrate alternative embodiments of the box member according to this invention.

As shown in FIG. 1A, instead of the embodiment of FIG. 1, seam 121 may be eliminated in elongated attachment portion 40′ by use of an L-shaped insert 45 which is soldered or welded into a slot provided between flanges 86′ on the top of the box member.

Figure 1B:
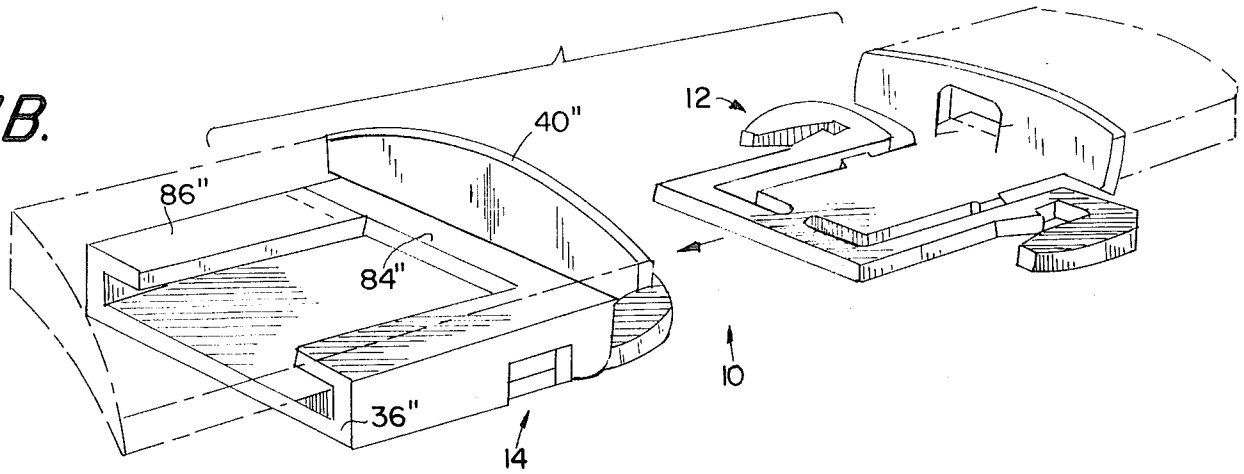

According to another embodiment shown in FIG. 1B slit 121 may also be eliminated by providing an elongated attachment portion 40″ integral with one side wall 36″.

Figure 3:
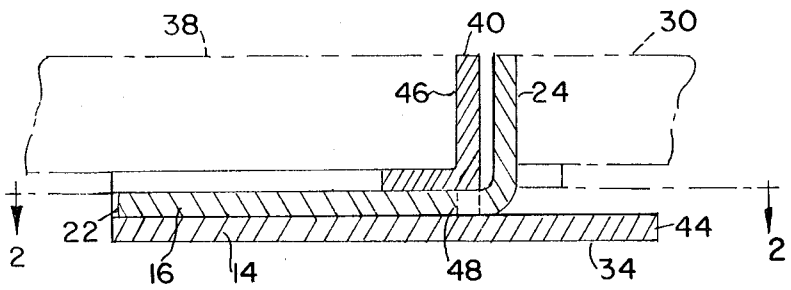
FIG. 3 is a elevation in section taken along lines III—III in FIG. 2.
Figure 2:
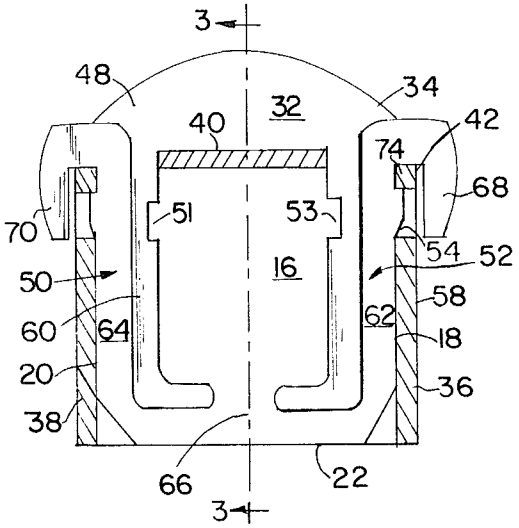
FIG. 2 is a top plan view, partially in section, of a clasp according to the present invention showing the members in mated position, and is a view taken generally along the line II—II in FIG. 3.

As shown in FIG. 2, tongue member 12 and box member 14 are constructed and arranged such that opposite edges 18, 20 of the tongue member slideably engage upstanding walls 36, 38 of the box member when front end 22 of the tongue member is inserted into opening 48. Upon insertion of the tongue member into the box member, edges 18 and 20 of the tongue member slideably engage walls 36 and 38 of the box member in order to guide the tongue member until it reaches its mating position at which attachment portion 24 is adjacent attachment portion 40 of the box member as shown in FIG. 3. The spacing between attachment members 24 and 40 is exaggerated in FIG. 3; and in actual fact, the attachment portions contact each other. In such case, ends 28 and 46 of jewelry 30 are almost in direct engagement when the tongue member is mated with the box member except for the thickness of the material of the attachment member which typically is about 0.030 inches. Thus, jewelry 30 completely covers and conceals all of the clasp except portions 24 and 40, and the clasp is unobtrusive with respect to the jewelry insofar as an outside observer is concerned. If desired, portions 24 and 40 may then be filed to conform themselves in shape to the contour of each end of the jewelry.

In order to releasably retain the tongue member to the box member, the tongue member is provided with a pair of resilient detents 50, 52 (FIG. 2) which are integral with and define the edges 18, 20, respectively, of the base 16 of the tongue member. Upstanding walls 36, 38 of the box member are provided with a pair of detent receptors 54 formed by wall 42, respectively, receiving detents 50, 52 thereby releasably preventing separation of the members when they are mated by insertion of the front end of the tongue member into opening 48 until attachment portions 24 and 40 on the members are adjacent each other.

Detents 50, 52 are formed by slitting base 16 of the tongue member as indicated at 58, 60 (FIG. 2) along the length of the base adjacent respective edges 18, 20. In this manner, a pair of resilient arms 62, 64 are formed, these arms being cantilevered to the base at centrally located junction 66 separating slits 58, 60 adjacent front end 22 of the base. Preferably, slits 58, 60 are L-shaped as shown in FIG. 2 for the purpose of providing the desired degree of resiliency of arms 62, 64. In certain smaller versions of the clasp the shapes of the slits may be altered or straightened. The thickness and configuration of the slits defines the resilience of the tongue member. In order to limit flexure of arms 62,64, projecting stops 51,53 are located in slots 58,60 opposite cam portions 66. The stops serve to assure the symmetric closure of the arms which in turn reduces jamming, and also serves to lengthen spring life.

As shown in FIGS. 1 and 2, each arm 62, 64 includes cam portion 66 (FIG. 1) that extends outwardly from edges 18 and 20 of base 16, the cam portion being tapered toward the front end of the base member as indicated in the drawing.

Arms 62, 64 terminate in U-shaped operating portions 68, 70 which are integral with the arms and define slots 72 into which cam portion 66 projects. The rearward end of these cam projections terminate in edges 74 which engage behind rib 42 in the box member when the members are mated as shown in FIG. 2.

As shown, operating portions 68 and 70 have a smooth rounded edge. However, alternatively, it is possible to have portions with flat straight edges which are capped with small knob-like bulbous "grips" which are welded or soldered onto the flattened operating portions. This approach provides for easier use since the bulbous portions can be more easily pressed.

Attachment portion 24 at the rear of tongue member 12 is bent upwardly out of the plane of base 16 for forming an elongated plate 76 against which end 28 of jewelry 30 abuts. To enhance the connection of end 28 to the attachment portion, support for end 28 is provided by slitting plate 76 as indicated at 80 thereby defining forwardly extending flange or tongue 82 which is bent out of the plane of plate 76 and into the plane of flange 72. Thus, end 28 of the piece of jewelry can be placed in abutment with plate 76 while the underside of the piece of jewelry at end 28 is supported by flange 82. Flange 82 is at the same level as flanges 84 and 86. When thus placed, the end of the jewelry can be bonded to the tongue by soldering, welding or other techniques well known in the art.

The other end 46 of the jewelry is attached to box member 14 in a similar manner. To facilitate this attachment, transverse attachment portion 40 on the box member includes perpendicular flange 84 extending away from the front end of the box member and coplanar with flanges 86 which are pendicular flanges integral with upstanding side walls 36 and 38 of the box member. Flanges 84, 86 serve to support and space the jewelry from the tongue member during soldering. This also makes it possible to easily secure both ends of the jewelry to the box and tongue members when the clasp members are separated. Thus, the box member can be bonded, e.g., welded, soldered, etc., to the piece of jewelry along the bottom and free end of the jewelry. Furthermore, each of the attachment portions of the members can be contoured, as shown in FIG. 1 to accommodate the curvature of the piece of jewelry thus rendering the clasp almost invisible when the members of the clasp are mated.

As shown in FIG. 1A, flanges 86′ are elongated to extend up to the upstanding attachment portion. L-shaped element 45 includes flange 84′ which is fitted between and soldered to flanges 86′.

As shown in FIG. 1B, flange 84" is extended so as to be folded down within a space provided by shortening flange 86" relative to flange 86' (FIG. 1A).

In operation, after the ends of the jewelry are respectively attached to the box member and to the tongue member as described above, mating of the members is achieved by simply inserting front end 22 of the tongue member into opening 48 in the box member. Insertion of the tongue member is guided by rounded portion 34. The rounded portion further serves to prevent hairs from being snagged within the clasp. Inward movement of the tongue in the box member is achieved by sliding engagement of arms 62, 64 within side walls 36, 38. Furthermore, flanges 86 on the upstanding walls further guide base 16 of the tongue member because flanges 86 are spaced from base 32 of the box member by a distance just sufficient to provide clearance for the passage of the base 16. When precisely constructed, flanges 86 hold down the tongue and prevent it from lifting up. The channels formed in the box by the walls and flanges add rigidity and strength to the box such that a minimum of material may be used.

Forward movement of the tongue into the box member is effected until cam members 66 engage ribs 42 of the box member. When this occurs, further inward movement of the tongue in the box member is accompanied by resilient deflection of arms 62, 64 as cam portions 66 engage ribs 42 on the box member. Stops 51,53 are dimensioned to permit sufficient deflection of arms 62,64 for cam portions 66 to clear ribs 42. This permits the cam member to slide inwardly against walls 36, 38 until the cam portion becomes aligned with notches 54, 56. When this occurs, the resiliency of arms 62, 64 causes them to snap outwardly until stops 74 are captured behind post 42. In this position, attachment portions 24 and 40 abut each other and the members are securely mated.

In order to disconnect the members, simultaneous pressure must be exerted inwardly against portions 68, 70 on arms 62 and 64 in order to withdraw cam portions 66 inwardly of the inside of walls 36, 38 on the box member. If this is achieved, outward movement of the tongue member relative to the box member will effect withdrawal of the tongue member from the box member. With this construction, inadvertent, or accidental inward pressure directed against one or the other of portions 68, 70 will not be sufficient to effect withdrawal of the tongue member from the box member. Only if cam portions 66 on each of arms 62, 64 are withdrawn simultaneously from notches 54, 56 will a disconnection of the tongue from the box member be effected.

Stops 51, 53 serve to equilibrate the pressures exerted on operating arms 68, 70 since each of 50, 52 can be flexed by only a predetermined amount. This extends spring life, and also equally distributes pressure over both detents 50, 52. Furthermore, it is noted that because of the configuration of the outer portions, and their spacing from the box member, the members are moved smoothly and evenly relative to one another. Upon compression of arms 68 & 70 the arms are compressed until they abut stops 53 & 51 respectively. In the event either of arms 68 or 70 is pressed more than the other arm taming of the tongue is prevented by virtue of the abutment of 68 or 70 against the outer-surface of the box.

While the Figures illustrate the use of perpendicular flange 84 at the end of the box member, this flange may less desirably be eliminated such that the tongue is guided in a track formed by flanges 86 alone. This may serve to further reduce the weight of the item, and the expense associated therewith.

Furthermore, as noted previously, attachment portion 40 has the advantage that it may be trimmed as desired so as to match and become flush with the article of jewelry to which it is attached. Attachment portions 24 and 40 preferably rise to the same height and are flush. These portions mate perfectly with almost no space between them.

Figure 4:
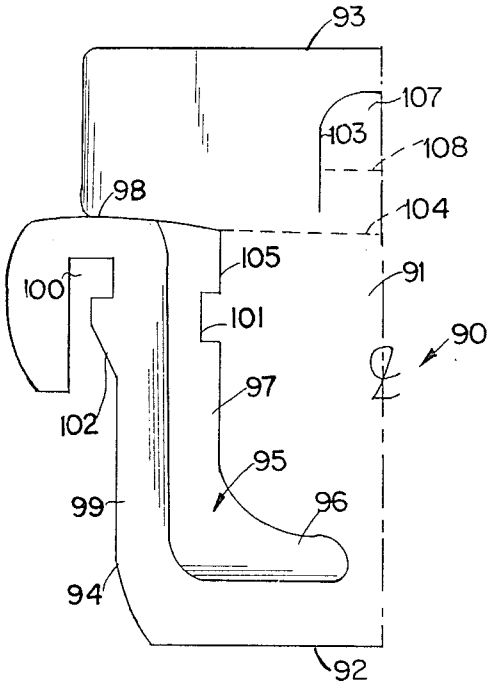
FIG. 4 is a portion of a blank from which the tongue member can be fashioned from a single sheet of material.

The invention also comprehends the construction of each of the tongue and box members from a sheet of material. Referring to FIG. 4, blank 90 represents a configuration from which tongue member 12 can be stamped from a sheet of material by notching, slotting, slitting and bending operations. Accordingly, blank 90 comprises flat plate 91 having front edge 92, rear edge 93, and parallel edges 94. A pair of facing, L-shaped slots 95 (only one of which is shown in FIG. 4) defined by edge 105, are symmetrically located in the plate. Each slot 95 has toe portion 96 adjacent, and parallel, to front edge 92 of the plate and extending towards side edges 94. Each slot 95 also includes leg portion 97 adjacent and parallel to side edges 94.

Each side edge of the plate is slit as indicated at 98 adjacent the free end of each leg portion 97 so that the slits define resilient arms 99 on opposite sides of the plate. Each arm 99 has slot 100 in the free end thereof opening towards front end 92 of the plate. Leg portion 97 is interrupted by projection 101 which projects into slot 97. In addition, slot 100 in each arm is provided with cam portion 102 aligned with stop 101. Finally, U-shaped slit 103 is provided in blank 90. By mechanical means, the blank may be bent along the bend line 104 so that portion 93 is disposed in a plane perpendicular to the plane containing arms 94. This portion of the device constitutes attachment portion 24 as shown in FIGS. 1 and 3. Finally, flange 82 of portion 24 is formed by bending region 107 along bend line 108.

Figure 5:
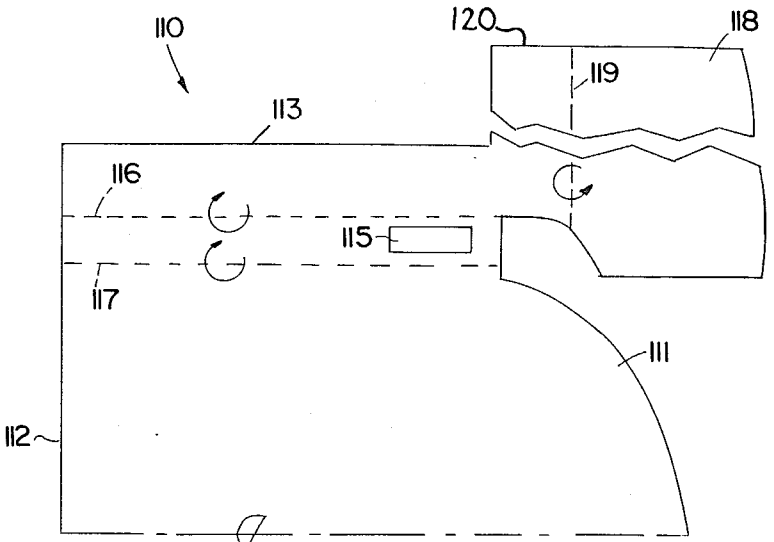
FIG. 5 is a portion of a blank from which the box member can be formed from a single sheet of material.

Blank 110 shown in FIG. 5, is suitable for forming box member 14, and is in the form of a sheet of material having front end 111, rear end 112 and sides 113 (only one of which is shown in FIG. 5). Aperture 115 is punched as indicated. After the punching and forming operations are complete, the blank may be bent along bend lines 116, 117 for the purpose of forming upstanding walls 36, 38 shown in FIG. 1; and edge 113 forms flanges 86 as shown in FIG. 1. Flange 84 is produced by bending portion 118 along bend line 119. The box member is completed by soldering or otherwise or welding outer edge 120 of the blank to a corresponding portion on the opposite side of the blank (not shown) after bending along the lines 116 and 117. The connection line is shown best in FIG. 1 by reference numeral 121. As noted previously in FIG. 1A, in order to save metal and make the center stronger, if desired, the attachment portion may be a single piece which is welded or soldered onto the box at the position shown in FIG. 1A. Alternatively, the attachment portion may be formed by elongating portions 118 and 120 shown in FIG. 5 such that they extend to the other side of the member when folded. (FIG. 1B).

The above described construction permits the economical production of jewelry clasps that are compact and unobtrusive yet able to be securely connected or disconnected at will.

It is believed that the advantages and improved results furnished by the method and apparatus of the present invention are apparent from the foregoing description of the preferred embodiment of the invention. Various changes and modifications may be made without departing from the spirit and scope of the invention as described in the claims that follow.

What is claimed is:

1. A clasp for connecting one end of a piece of jewelry to the other end thereof, said clasp comprising:

(a) a tongue member having a base with opposite sides, a front end on said base, and a transverse attachment portion at the rear end of the base for attachment to said one end of the piece of jewelry;

(b) a box member having a base with a front end and with opposite, upstanding side walls, and a transverse attachment portion connecting said side walls at the front end of the base for attachment to said other end of the piece of jewelry;

(c) the attachment portion of said box member forming a transverse opening wide enough to receive the front end of the base of said tongue member;

(d) said tongue and box members being constructed and arranged such that said opposite sides of said tongue member slideably engage said upstanding side walls of said box member when the front end of said tongue member is inserted into said opening;

(e) a pair of resilient detents on said tongue member integral with and defining the sides of the base thereof, said detents being spaced from the remainder of the base of said tongue member along the length of the base adjacent the edges thereof by slits to form a pair of resilient arms that are cantilevered to the base adjacent the front end thereof; and (f) a pair of detent receptors in said upstanding walls in said box member for receiving said detents and releasably preventing separation of the members when the latter are mated by inserting the front end of said tongue member into said opening until the attachment portion on said tongue member is adjacent to the attachment portion on said box member.

2. A clasp according to claim 1 wherein said upstanding side walls on said box member terminate in perpendicular flanges that overlie the base thereof and form a support for said other end of said jewelry.

3. A clasp according to claim 2 wherein said perpendicular flanges extend until said transverse attachment portion.

4. A clasp according to claim 3 wherein said transverse attachment portion on said box member includes an inwardly extending perpendicular flange extending away from the front end, said inwardly extending perpendicular flange extending between said perpendicular flanges and being coplanar therewith.

5. A clasp according to claim 2 wherein said transverse attachment portion on said box member includes and inwardly extending perpendicular flange attached thereto extending away from the front end, said last mentioned flange being coplanar with the flanges on said upstanding walls and forming therewith, a support for said other end of the piece of jewelry.

6. A clasp according to claim 5 wherein said inwardly extending perpendicular flange is an extension of at least one of said perpendicular flanges.

7. A clasp according to claim 6 wherein both of said perpendicular flanges end in a perpendicular extension extending toward the center of said box member.

8. A clasp according to claim 6 comprising a perpendicular extension of one of said perpendicular flanges which extends and is secured to the other of said perpendicular flanges.

9. A clasp according to claim 1 wherein said transverse attachemnt portion on said tongue member includes a perpendicular flange for forming a support for said one end of the piece of jewelry.

10. A clasp according to claim 2 wherein said box member includes an extension at the front end thereof projecting beyond the transverse attachment portion on the box member for guiding insertion and removal of said tongue member.

11. A clasp according to claim 1 wherein the slits are L-shaped.

12. A clasp according to claim 1 wherein each arm includes a cam portion that extends outwardly therefrom and is tapered toward the front end of the base of the tongue member.

13. A clasp according to claim 12 wherein said detent receptors are apertures in said upstanding side walls for receiving the cam portions when said members are mated.

14. A clasp according to claim 13 wherein each arm terminates in an operating portion accessable from the exterior of said clasp when the members are mated, and located on opposite sides of the clasp, the members being constructed and arranged such that inwardly directed pressure simultaneously applied to the operating portions is required to flex the arms toward each other and retract the cam portion from the openings to effect withdrawal of the tongue member from the box member.

15. A clasp according to claim 14 wherein each of said operating portions is capped with a rounded element.

16. A clasp according to claim 15 wherein the slits in said tongue member are narrower adjacent the cam portions of the arms for forming stops that limit inward flexure of the arms.

17. A clasp tongue member having a base with opposite sides, a front end on said base, and a transverse attachment portion at the rear end of the base for attachment to one end of a piece of jewelry, said tongue member comprising a pair of resilient detents on said tongue member integral with and defining the edges of the base thereof, said transverse attachment portion on said tongue member including a perpendicular flange for forming a support for said one end of said piece of jewelry, said detents being formed by splitting the base of said tongue member to form slits along the length of the base adjacent the edges thereof to form a pair of resilient arms that are cantilevered to the base adjacent the front end thereof, said clasp tongue member being adapted for insertion into a box member having a base with a front end and with opposite, upstanding side walls, and a transverse attachment portion for connecting the side walls at the front end of the base for attachment to the other end of said piece of jewelry.

18. A clasp tongue member according to claim 17 wherein the slits and the base of the tongue member are L-shaped.

19. A clasp tongue member according to claim 17 wherein each arm includes a cam portion that extends outwardly therefrom and is tapered toward the front end of the base of the tongue member.

20. A clasp tongue member according to claim 19 wherein each arm terminates in an operating portion located on opposite sides of the clasp, the member being constructed and arranged such that inwardly directed pressure simultaneously applied to the operating portions is required to flex the arms toward each other.

21. A clasp according to claim 19 wherein each of said operating portions is capped with a rounded element.

22. A clasp according to claim 17 wherein the slits in said tongue member are narrower adjacent the cam portions of the arms for forming stops that limit inward flexure of the arms.

* * * * *

UNITED STATES PATENT AND TRADEMARK OFFICE

CERTIFICATE OF CORRECTION

PATENT NO. : 4,713,865

DATED : December 22, 1987

INVENTOR(S) : Simon GELDWERTH

It is certified that error appears in the above-identified patent and that said Letters Patent is hereby corrected as shown below:

At column 1, line 6, change "and" to ---an---.

At column 1, line 6, delete ";".

At column 1, line 7, insert ---the--- after "to".

At column 4, line 4, change "end one of" to ---end of---.

At column 4, line 57, change "a" to ---an---.

At column 6, line 51, change "pendicular" to ---perpendicular---.

At column 9, line 58 (i.e., claim 5, line 3), change "and" to ---an---.

Signed and Sealed this

Sixteenth Day of July, 1991

*Attest:*

*Attesting Officer*

HARRY F. MANBECK, JR.

*Commissioner of Patents and Trademarks*